United States Patent [19]

Shallenberger et al.

[11] 4,072,078

[45] Feb. 7, 1978

[54] SYSTEM FOR AUTOMATICALLY PRODUCING TONE PATTERNS

[75] Inventors: Larry R. Shallenberger, Mishawaka, Ind.; James S. Southard, Union, Mich.

[73] Assignee: C.G. Conn, Ltd., Oak Brook, Ill.

[21] Appl. No.: 677,975

[22] Filed: Apr. 19, 1976

[51] Int. Cl.[2] ..... G10H 1/00; G10H 5/00

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,548,066 | 12/1970 | Freeman | 84/1.03 |
| 3,590,129 | 6/1971 | Freeman | 84/1.01 |
| 3,688,009 | 8/1972 | Wangard | 84/1.03 |
| 3,811,003 | 5/1974 | Harris | 84/1.03 |
| 3,918,341 | 11/1975 | Bunger | 84/1.01 |

*Primary Examiner*—Stanley J. Witkowski
*Attorney, Agent, or Firm*—Drummond, Nelson & Ptak

[57] ABSTRACT

A tone pattern generating system for use with an electronic musical instrument, such as an electronic organ, responds to depression of a pedalboard key and a preselected rhythm and chordal pattern in an ROM memory to produce a "walking bass" automatically in response to continued depression of the selected pedal key. The ROM memory may be programmed to produce different tonal and rhythm effects in accordance with the wishes of the musician. In addition, provision is made for starting each rhythm and tonal pattern controlled by the ROM memory at the beginning of the pattern each time a new pedal key is played or released and replaying of the same pedal key is effected by the musician. The system also operates to immediately play the note selected by depression of the pedal key and prevents the production of tones under control of the ROM memory for a predetermined time interval following initial depression or operation of a pedal key. This permits the musician, in effect, to override the automatic tone pattern generation and play tone patterns of his own selection when desired.

13 Claims, 5 Drawing Figures

H.F. OSC.
25
24
T.O.S
FREQ.
DIVIDERS
C
C#
D
D#
E
F
F#
G
G#
A
A#
B
103
NOTE DECODE
16B
15
106
105
108
LATCH STROBE
19
111
OCTAVE DIVIDERS
32
16
8
4
2
100
101
OCTAVE DECODE
16A
17
112
109
26
TONE OUT TO KEYER 27

SYSTEM FOR AUTOMATICALLY PRODUCING TONE PATTERNS

BACKGROUND OF THE INVENTION

In conjunction with electronic musical instruments, and more particularly electronic organs, there has been substantial development in the area of automatically controlled rhythm accompaniment devices used to produce percussion rhythm patterns on selected instruments as controlled by the musician playing the organ. Generally, such organs are capable of producing a number of various rhythm patterns which are selected by a selection switch; and each of the patterns are capable of reproduction at various beat frequencies, also under control of the musician.

Systems also have been developed for pedal tone pattern generation, typically in conjunction with a string bass tonal effect, in which the musician selects a root or tonic note which is harmonious with the keyboard notes he is playing. The tone pattern system then produces alternating chordal or tonal effects based on the selected tonic root note, and these tonal effects are produced in cooperation with a rhythm system in the organ or musical instrument.

One disadvantage to the systems which have been utilized in the prior art to produce alternating bass tonal effects, which otherwise may be termed "walking bass" tonal effects, is that of providing maximum flexibility of control to such systems by the musician. Most such systems do not permit independent playing of the notes of the pedalboard when the automatic or "walking bass" system is switched into its operative mode. In addition, such systems in the past have a fixed pattern or pattern cycle which is continuously repeated within the organ, irrespective of the playing of different notes on the pedalboard by the musician. This forces the musician's playing to be slaved to the unvarying automatic pattern which he has preselected. Thus, any change from one root or tonic note to another by the musician must be made by him in synchronism with the automatic pattern or musically strange or unpleasant effects result. For example, if the automatic "walking bass" system is generating a tone pattern of four notes repetitively, and the musician desires to change to a new tonic note at the second note of such a pattern, the prior art systems generally continue the pattern; so that when the new tonic note is selected by the musician on the pedalboard, the effect merely is to transpose the generated tones to the second chordal note of the pattern associated with the newly selected tonic note without first playing the tonic note. The tonic note then only is sounded or played after the automatic system completes its cycle and commences a new cycle. This has been found to be very frustrating to many musicians who wish to have flexibility in their playing to select and sound a new tonic note and restart the "walking bass" pattern at the beginning, irrespective of where they interrupt the previous pattern by playing a new tonic note.

Furthermore, systems of the prior art also have resulted in some unusual effects being produced when a musician plays a pedal key slightly out of synchronism with the automatic rhythm generated within the organ. This often produces a double playing of the tonic note, once when it is fist selected by the musician and a second time in response to the automatic pattern. Or the first two notes of the pattern are played in rapid succession, with the remaining notes of the pattern then being played in their normal sequence at the proper time or beat intervals. Once again, this is a result of the slaving of the musician's playing to the internal automatic timing of the organ, rather than causing the timing of the "walking bass" operation of the organ to be dependent on the manner of playing effected by the musician.

It is desirable to provide a system for automatically producing tone patterns based on a tonic note in an electronic organ which provides a greater degree of flexibility to the musician than previously has been attainable with prior art systems. More specifically, it is desirable to cause each tone pattern to be restarted at the beginning each time the musician selects or plays a different pedal note. It also is desirable to permit the musician to override the automatic tone pattern system whenever he desires to play different tone patterns of his own choosing or to momentarily change the walking bass tone patterns and then subsequently revert back to the automatic system.

SUMMARY OF THE INVENTION

It is an object of the present invention to provide an improved tone generator system.

It is another object of this invention to provide an improved tone pattern generating system for producing a pattern of tones of different frequencies based upon a selected root tone.

It is an additional object of this invention to provide an automatic tone pattern generating system which may be overriden at the will of the musician.

It is a further object of this invention to provide a tone pattern generating system which is restarted at the beginning of each pattern sequence each time a new root note is selected or reselected by the musician.

It is still another object of this invention to provide a tone pattern generating system for an electronic organ.

It is still a further object of the invention to provide a tone pattern generating system which prevents double tone triggering effects by actuation of a pedal key slightly out of tempo with an automatic rhythm beat in an electronic musician instrument.

In accordance with a preferred embodiment of this invention, a tone pattern generating system for use with an electronic musical instrument, such as an electronic organ, includes a continuously running clock for producing output pulses at a predetermined frequency. A pattern control circuit, preferably in the form of an ROM memory, is used to store different combinations of chordal tone relationships and rhythm patterns which may be selected by the musician. The clock is coupled with the pattern control ROM to control the frequency at which the rhythm patterns and changes in the chordal tone relationships take place.

A switch, operated in response to initiation of playing of a note in the instrument, is coupled to an output circuit along with the pattern control circuit for producing varying musical tones in a predetermined rhythm pattern. A tone generator and keyer circuit also is coupled with the pattern control circuit and the switch for producing varying musical tones in a rhythm pattern established by the pattern selected in the pattern control circuit. A further circuit, responsive to the operation of the switch, prevents the pattern control circuit from controlling the keyer for a predetermined time interval after each operation of the switch.

DETAILED DESCRIPTION

Figures 1, 5:
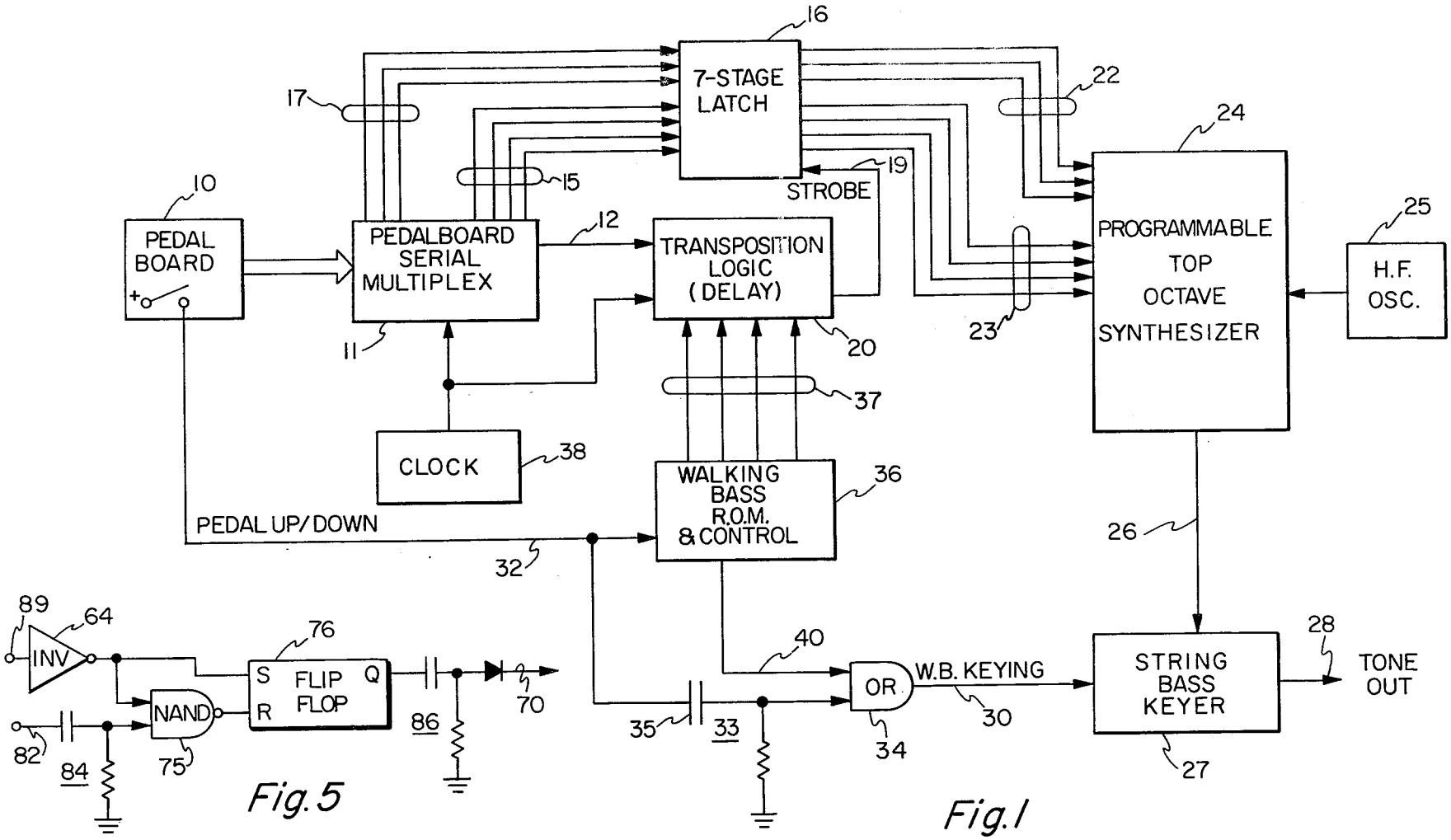
FIG. 1 is a block diagram of a preferred embodiment of the system according to this invention.
FIG. 5 is a block diagram of a circuit used in conjunction with the circuit of FIG. 2.

In the drawings, like reference numerals denote corresponding elements throughout the several views. Referring now to FIG. 1, there is shown a block diagram of a preferred embodiment of the invention used in conjunction with a digital serial multiplex electronic organ system. The serial multiplex organ system with which the system shown in FIG. 1 is used preferably is of the type disclosed in copending application Ser. No. 561,970, filed Mar. 26, 1975, now U.S. Pat. No. 3,955,460, issued on May 11, 1976, and assigned to the same assignee as the present invention. The disclosure of this copending application is incorporated herein by reference to avoid the necessity of unnecessarily complicating the present disclosure, directed to a "walking bass" system, with the details of the serial multiplex system with which the walking bass system is used.

A keyboard in the form of a pedalboard 10 is used in the organ, which also may have one or more other keyboards or manuals. Selection of a note by operation of a pedal key in the pedal board 10 causes the generation of a uniquely encoded pulse in the serial multiplex pulse train by the serial multiplex circuit 11, as described in detail in the above-mentioned copending application.

A serial data train is supplied from the output of the serial multiplex circuit 11 on a lead 12 and has a pulse located in it uniquely corresponding to the note selected by the operation of the key in the pedalboard 10. The manner in which this is accomplished is described in greater detail in the above-mentioned copending application and will not be repeated here. It is sufficient to state that the serial pulse data train on the lead 12 includes a pre-established number of serial pulse positions, 135 in the above-identified application, and one of those pulse positions uniquely corresponds with the note selected by the pedalboard 10. The data train on the lead 12 is solely representative of the notes selected by the pedalboard 10 and does not include any information from any of the other keyboards or manuals of the organ. Thus, when a single pedalboard note is played, a single pulse appears in a unique one of the 135 pulse positions in each cycle of the serial data train on the lead 12 representative of the selected note.

Each different pulse position in the data train generated by the serial multiplex circuit 11 uniquely identifies a different note out of all of the notes which may be produced by the organ. In an organ of the type disclosed in the aforementioned copending application, all of the notes of an octave may be uniquely identified by a four-bit binary code and such note identification is supplied over four leads 15 to four corresponding stages of a seven-stage binary latch circuit 16. Similarly, the appropriate octave information for the organ may be identified by a three-bit binary number, and this binary encoded identification is applied over three leads 17 to three other stages of the seven-stage latch circuit 16. As each different possible pulse position is sequentially scanned by the serial multiplex circuit 11, the information supplied to the seven inputs of the seven-stage latch circuit 16 uniquely changes in accordance with the pulse position identifying a particular note in a particular octave from the serial multiplex circuit 11. The inputs to the latch circuit 16 change simultaneously with each change in the pulse position of the serial data signal train applied over the lead 12.

Until a strobe or latching signal is applied over a lead 19 in parallel to the seven stages of the latch circuit 16, no change in the outputs of the latch circuit 16 takes place, irrespective of changes which may take place on the binary encoded inputs to the latch circuit. A transposition logic circuit 20 is used to produce the strobe pulse on the lead 19. This strobe pulse is derived from the pulse in the binary signal train applied to the input of the transposition logic circuit 20 on the lead 12. The transposition logic circuit 20 is operated as a variable delay; and if no transposition in the note or tone produced by the pedalboard 10 is desired, the pulses on the lead 12 pass undelayed through the transposition logic circuit 20 to the output strobe lead 19. Thus, a strobe pulse is obtained in synchronism with the generation of the serial multiplex data stream 12 to latch the seven-stage latch 16 for the note and octave corresponding with the root note selected by the pedalboard 10. This information then is applied over a corresponding set of three octave leads 22 and four binary encoded note leads 23 to the input of a programmable top octave synthesizer circuit 24 of the type commonly employed in electronic organs today.

A high frequency oscillator 25 provides a stable high frequency signal to the top octave synthesizer circuit 24, and this signal is divided down in accordance with the encoded octave and note information on the leads 22 and 23 to produce the desired output tone frequency from the synthesizer on the lead 26. This tone is applied to a string bass keyer 27, which in turn supplies the desired tones on an output terminal 28 in accordance with timing pulses applied to the input of the keyer 27 over a walking bass keying lead 30.

Each time a note is selected by depression of a pedal key in the pedalboard 10, whether this is a new note or a repetition of the same note, a pulse is produced on a lead 32 and is applied through a differentiation circuit 33 to one input of an OR gate 34 to result in a walking bass keying pulse on the lead 30. This causes the string bass keyer 27 to produce the root note tone on the output terminal 28. If the pedal key continues to be held down in the pedalboard 10, the signal on the lead 32 remains, and is applied to the walking bass ROM memory and control circuit 37, which automatically generates walking bass chordal tone patterns and rhythm patterns preselected by the musician.

The walking bass chordal tone patterns are encoded on four output leads 37 connected to the transposition logic circuit 20 to select the variable delay to be imposed upon the serial pulse data train 12 supplied to the input of the transposition logic circuit. The transposition logic circuit 20 is operated in synchronism with the serial multiplex circuit 11 by a multiplex clock circuit 38, which supplies the same basic timing signals to both the multiplex circuit 11 and the transposition logic delay circuit 20.

The walking bass ROM control circuit 36 includes a tempo clock oscillator circuit which causes the chordal tone patterns on the leads 37 to change at a rate selected by the musician in accordance with the tempo of the musical selection he is playing. The change of the chordal tone relationships encoded on the leads 37 is at a much lower rate than the clock frequency of each cycle of the multiplex signal appearing on the lead 12.

The result of the changes of the chordal tone relationships encoded on the leads 37 is to cause varying amounts of delay to be imparted to the serial data multiplex signal passing through the transposition logic circuit 20. Thus, the strobe pulses appearing on the lead 19, in effect, cause the seven-stage latch circuit 16 to latch on input signal conditions on the leads 15 and 17 which are representative of higher notes or tones than the root note selected by the pedalboard 10. This is reflected on the output leads 22 and 23 to cause the frequency appearing on the output lead 26 of the programmable top octave synthesizer 24 to change to higher tones corresponding to the pattern produced by the walking bass ROM and control circuit 36.

At the same time, the circuit 36 produces a sequence of rhythm pattern pulses, synchronized to the changes in tone patterns on the leads 37, on a rhythm pattern lead 40 connected to a second input of the OR gate 34. These pulses are passed by the OR gate to the keying lead 30 to enable the string bass keyer 27 to produce the desired pattern of walking bass tone signals on the output lead 28. This operation continues so long as the pedal key is held down by the musician.

It should be noted that during the time a pedal key is held down, the capacitor 35 of the differentiating circuit 33 operates as a DC blocking capacitor, so that the lower input to the OR gate 34 has no affect during such steady state operation. On the other hand, each time the musician selects a new note or repeats a note by releasing and reoperating a key in the pedalboard 10, his root note selection is accompanied by a new keying pulse passed through the lower input of the OR gate 34. This function, coupled with a predetermined delay in the circuit 36 to prevent the application of pulses on the lead 40 for a short pre-established time interval following selection of a new note in the pedalboard 10, permits the musician to override the operation of the walking bass control circuit 36 and to play rhythm of his own selection, if desired, even though the walking bass control circuit 36 may be turned on. This provides the musician with a maximum degree of musical flexibility in utilizing the automatic walking bass system of this invention.

Figure 2:
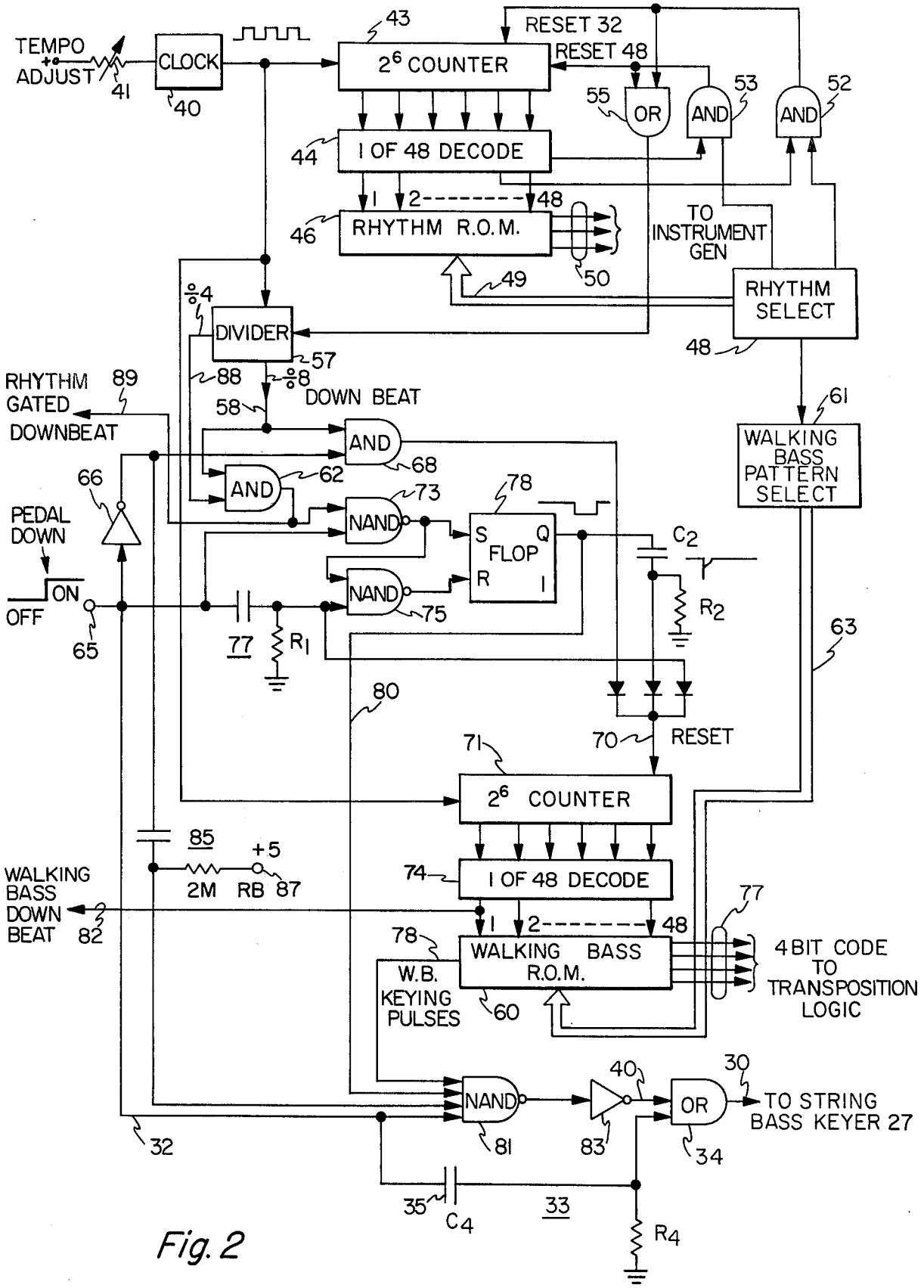
FIG. 2 is a more detailed block diagram of a preferred embodiment of a portion of the system shown in FIG. 1.

Referring now to FIG. 2, there is shown a detailed block circuit diagram of the walking bass ROM and control circuit 36. In most commercial applications, a walking bass rhythm pattern generating circuit will be used in conjunction with a percussion rhythm pattern generating system of the type which is widely used in electronic organs to automatically generate percussion rhythm patterns in accordance with a pattern selection switch setting as determined by the musician.

The tempo or beat of such rhythm patterns in the system of FIG. 2 is established by a clock oscillator circuit 40 over a range of tempo frequencies which are selected by a potentiometer 41. The potentiometer 41 is adjusted by the musician until the desired tempo is attained. The pulses appearing on the output of the clock 40 are applied to the input of a six-stage binary counter circuit 43, the six outputs of which are coupled to the input of a suitable one-of-forty-eight decoding circuit 44 which has forty-eight outputs, each of which is energized sequentially in response to each output pulse from the clock circuit 40.

The outputs from the circuit 44 are applied to corresponding inputs of a rhythm ROM memory circuit 46 which may be used to store several different rhythm patterns for activating percussion instruments in accordance with the stored patterns to produce the desired percussion rhythm effect automatically in the organ. A rhythm select switching circuit 48, which may be of suitable conventional design, applies an addressing or decoding input over a group of addressing leads 49 to address the particular rhythm section of the rhythm ROM 46 which corresponds to the desired rhythm pattern. The output of the rhythm ROM 46 is illustrated as a three-lead output applied over the leads 50 to the selected rhythm pattern instrument generators. This portion of the circuit shown in FIG. 2 is conventional and has been employed in electronic organs to generate desired rhythm patterns.

Since the rhythm patterns may be repeated in different numbers of measures or beats, typically 32 or 48 beats, the outputs from the one-of-forty-eight decode circuit 44 which correspond to the count of 32 and the count of 48 are applied to respective inputs of a pair of AND gates 52 and 53. When the desired rhythm pattern is selected, an enabling input is applied to one or the other of these AND gates; so that whenever the count from the output of the decode circuit 44 corresponding with the enabled AND gate 52 or 53 is reached, that AND gate provides a reset pulse to the counter 43 to reset it to its initial count. Thus, the system operates to maintain the desired measure or repeat information from the output of the rhythm ROM 46 which corresponds to the number of counts or beats from the clock 40 for the selected rhythm pattern.

The outputs of the AND gates 52 and 53 are also applied to an OR gate 55 which provides an output pulse each time one or the other of the AND gates 52 or 53 provides an output pulse. This pulse is used to reset a divide-by-eight divider circuit 57 to its initial count. The input to the divider circuit 57 is the output from the clock circuit 40, and the output of the divide-by-eight circuit 57 is applied over a lead 58 to function as a downbeat synchronizing count for the walking bass circuit which forms the remainder of the circuit shown in FIG. 2.

The rhythm generator portion of the circuit of FIG. 2 which has been described thus far operates independently of any operation of the pedal keyboard of the organ. This portion of the circuit may be used in conjunction with the remainder of the circuit shown in FIG. 2, or it may be eliminated, and the walking bass portion of the circuit may be used alone. However, in most applications, both a rhythm pattern generating circuit for generating a percussion rhythm pattern and a walking bass circuit will be used together.

The particular walking bass chordal tone pattern and rhythm pattern is selected in a walking bass ROM memory 60 which is similar to the rhythm ROM memory 46. The ROM memory 60 is encoded to store a predetermined number of chordal tone and rhythm pattern combinations for effecting the desired walking bass tone patterns and rhythm patterns. Walking bass pattern selection is effected by a pattern selection addressing circuit 61, which is either operated independently or which may be slaved to the rhythm selection circuit 48; so that the selected walking bass patterns are compatible with the automatic rhythm patterns generated by the rhythm ROM 46. In any event, the walking bass pattern selection information is applied over address leads 63 to the walking bass ROM 60 to select the desired walking bass pattern. The manner in which the addressing of the walking bass ROM 60 is specifically accomplished is not important to the present description. It may be accomplished by a number of conventional mechanical, electronic or electro-mechanical switching circuits.

Irrespective of whether the walking bass circuitry is enabled for operation or not, each time a pedal in the pedalboard circuit 10 (FIG. 1) is depressed, a positive-going signal is applied to a terminal 65 and over the lead 32 and through the coupling capacitor 35 in the differentiating circuit 33 to the OR bate 34, as described previously in conjunction with FIG. 1. In addition, the positive-going signal appearing on the terminal 65 is inverted by an inverter circuit 66 to disable an AND gate 68, causing the output of that AND gate to go low. Normally, the output of the AND gate 68 is low since the other input to this AND gate constitutes the normally low divide-by-eight output of the divider circuit 57 appearing on the lead 58.

Thus, whenever no pedal is shown or operated in the pedalboard circuit 10, the AND gate 68 is normally enabled. Once each measure of eight counts, a positive or high downbeat pulse is applied to the AND gate 68 from the divider circuit 57. This causes the gate output to go high to produce a reset pulse which is applied through a blocking diode to a reset lead 70 applied to a six-stage binary counter 71 to reset the counter to its zero count.

The counter 71 is similar to the counter 43 used in the rhythm pattern generator portion of the circuit. Clock pulses from the output of the clock circuit 40 are supplied to the counter 71 in parallel with the clock pulses applied to the counter 43. Thus, the counter 71 is recycled or reset for each eight beat measure in synchronism with the operation of the rhythm circuit 46 in the absence of any playing of notes in the pedalboard keyer 10. This causes the counter 71 to be continuously ready for the initiation of a walking bass note sequence by activation or closure of a pedalboard key. When a pedalboard key is closed, the AND gate 68 is disabled. At the same time, however, a NAND gate 73 is enabled by the now high or positive input on the terminal 65.

The output of the NAND gate 73 normally is a high output which is used to enable a second NAND gate 75. When the pedal note first is selected, the negative-to-high pulse transmission on the terminal 65 is applied through a differentiating circuit 77 to the input of the NAND gate 75 as a positive-going pulse, which in turn causes the output of the NAND gate 75 to go low. This output is applied to the reset trigger input of a flip-flop circuit 78 to cause the output of the flip-flop 78 to go low. This low output is applied over a lead 80 to one of four inputs of a NAND gate 81 to disable that NAND gate forcing its output to go high. This output is inverted by an inverter circuit 83 which in turn produces a low output on the lead 40, so that the walking bass control circuit does not produce any keying pulses through the OR gate 34, so long as a low output appears on the lead 80.

If the musician continues to hold the selected pedalboard key down or operated, the potential on the lead 65 remains high. The capacitor in the differentiating circuit 77 then operates to block this potential from the lower input to the NAND gate 75 and the NAND gate 75 then is disabled. The high potential applied to the lower input of the NAND gate 73 from the terminal 65, however, continues to enable the NAND gate 73. The next time then that a downbeat pulse signifying the beginning of a measure in synchronism with the rhythm circuit is obtained out of the circuit 57, it appears in the form of a positive pulse on the lead 58. This pulse is applied to the upper input of the NAND gate 73 and results in a negative-going output from that NAND gate. This negative-going output further serves to disable the NAND gate 75 and is applied to the set input of the flip-flop 78, causing the output of the flip-flop 78 once again to go positive.

This enables the NAND gate 81 to permit control of the pulses on the lead 30 to be effected from the walking bass ROM circuitry 60.

At the same time, the positive-going pulse at the output of the flip-flop 78 is applied through a differentiating circuit and an isolating diode to the reset input 70 for the counter 71, causing the counter 71 to be reset to commence its cycle of operation at a measure downbeat. As described previously, this downbeat in turn is in synchronism with the operation of the rhythm generator portion 46 of the circuit.

The outputs of the counter circuit 71 are applied to a one-of-forty-eight decode circuit 73 which is similar to the circuit 44 previously described. The outputs of the one-of-forty-eight decode circuit 74 then are applied one at a time to the walking bass ROM circuit 50 to effect a binary encoded chordal note relationship to be applied to four output leads 77 in accordance with the selected walking bass chordal note pattern at time intervals determined by the pattern encoded in the walking bass ROM.

At the same time, walking bass keying pulses are applied over a lead 78 comprising a second output from the walking bass ROM 60. These walking bass keying pulses on the lead 78 coincide with preselected ones of the pulses from clock circuit 40 in a pattern relationship which is established by the encoding in the walking bass ROM 60. The manner in which this is done is conventional, and the patterns for different walking bass effects can be different from one another. Generally, the first keying pulse on the lead 78 for each pattern is in synchronism with the downbeat pulse appearing on the lead 58 at the output of the circuit 57. This does not necessarily have to be the case, however.

In the event that the musician depresses a key in the pedalboard keyer 10 just prior to the time that the rhythm generator circuit is producing a downbeat on the lead 58, it is desirable to prevent the first walking bass keying pulse appearing on the lead 78, which normally is the downbeat and root note pulse, from being passed through the NAND gate 81 to avoid an annoying unwanted double note effect. This is accomplished by a delay differentiating circuit 85 coupled to the output of the inverter 66. The circuit 85 typically has a time out period on the order of 200 milliseconds, and applies a negative disabling signal to the NAND gate 81 for this time period immediately following operation or closure of a key in the pedalboard 10. After this time out period, the positive potential appearing on the terminal 85 causes the NAND gate 81 once again to be enabled, and further walking bass keying pulses on the lead 78 will be passed by the NAND gate 81 and the OR gate 34 to the keyer 27 to control the operation of the keyer 27. Thus, the timing of the keying pulses to the keyer 27 are controlled in synchronism with and substantially slaved to the operation of the rhythm pattern circuit.

Once the pedal switch is depressed, there needs to be a way of keeping the walking bass operation in synchronism with the rhythm pattern generated by the rhythm pattern generator ROM 46. This is accomplished with the circuit of FIG. 5. The walking bass downbeat must occur at the same time the rhythm downbeat occurs. In fact, the walking bass downbeat must occur during the first half of the rhythm downbeat pulse.

The rhythm downbeat out of the divider 57 on the lead 58 is combined with the divide-by-four output on a lead 88 from the divider 57 in an AND gate 62 to form a gated downbeat pulse on a lead 89. The second half of the original downbeat pulse thus is gated out, leaving only the first half. This gated downbeat pulse is fed to the "set" input of an RS flip-flop 76 through an inverter 64. This inverted pulse also is fed to one input of a NAND gate 75.

The walking bass downbeat pulse on a lead 82 (FIGS. 2 and 5) is differentiated by a differentiating circuit 84, and the positive-going pulse which coincides with the leading edge of the walking bass downbeat is applied to the other input of the NAND gate 75. The output of the gate 75 is connected to the "reset" input of the flip-flop 76. The output of the flip-flop 76 is differentiated by a network 86 and finally is coupled through an isolating diode to the reset lead 70 (FIG. 2) of the counter 71. Whenever the output of the flip-flop 76 goes positive, a positive pulse is applied to the reset lead 70 of the counter 71, resetting it to its initial count.

The gated rhythm downbeat pulse always "sets" the RS flip-flop 76, if the RS flip-flop has previously been "reset". This, then, causes the output of the flip-flop 76 to go positive. This same rhythm downbeat pulse, which is negative-going as a result of the inverter 64, is also applied to one input of the NAND gate 75, inhibiting the operation of the gate 75. Thus, if a walking base downbeat pulse arrives at the other input of the gate 75 during the time the negative rhythm downbeat pulse is applied to the first input of the gate 75, the output of the gate 75 remains high and does not reset the flip-flop 76. The output of the flip-flop 76 then remains high and no new reset pulse is sent to the walking bass counter 71.

If a walking bass downbeat pulse arrives at the NAND gate 75 at any time when the rhythm downbeat pulse is not present at the other input of the gate 75, then the output of the gate 75 goes "low", upon occurrence of the walking bass downbeat pulse, resetting the flip-flop 76, causing its output to go low. Now, when the next rhythm downbeat pulse occurs, it sets the flip-flop 76, causing its output to go "high". This results in the application of a positive pulse to the reset input of the walking bass counter 71, thereby synchronizing the walking bass circuit to the rhythm circuit operation.

At the same time that the keying or pattern pulses are applied to the string bass keyer 27 from the output of the OR gate 34, the chordal note relationship which is to accompany each of these pulses is selected by the binary encoded outputs appearing on the lead 77. The encoded output which corresponds to the transposed chordal note relationship for automatically generating the walking bass pattern is applied to a transposition ROM memory 90 (FIG. 3) which decodes the information on the leads 77 to a one-out-of-thirteen output supplied to a selected one of thirteen output leads 91 which correspond with the group note (zero transposition) on up to each of the notes within the octave including the note one octave higher than the root note. Each of these outputs 91 is connected to the enabling input of a respective different corresponding AND gate 93. There are thirteen AND gates 93, all having their outputs connected in common to the latch strobe lead 19. The root note AND gate 93 is the left-hand gate of FIG. 3, whereas the AND gate representative of a transposition of one octave higher is the right-hand one of the AND gates 93 shown in FIG. 3. The other AND gates 93 each are representative of one note increments in the octave between the root note and the octave higher note. Only one of the AND gates 93 is enabled at any one time.

The serial data pulse train from the multiplex circuit 11 appearing on the lead 12 is applied directly to the AND gate 93; and whenever the root note is selected, that AND gate 93 is enabled to pass undelayed pulses from the multiplex circuit 12 through it to the latch strobe output 19. The multiplexed pulses appearing on the lead 12, however, also are applied to the input of a twelve-stage shift register circuit 94, which is shifted at the multiplex clock rate by clock pulses from the clock circuit 38 applied to the shift pulse input lead 95. The shift register 94 is reset to its zero state of operation at the commencement of each cycle of the serial data pulse stream from the multiplex circuit 11. The manner in which this is done is not shown in FIG. 4, but such resetting is accomplished in a conventional manner from a strobe pulse which is available in the multiplex circuit 11.

Figure 3:
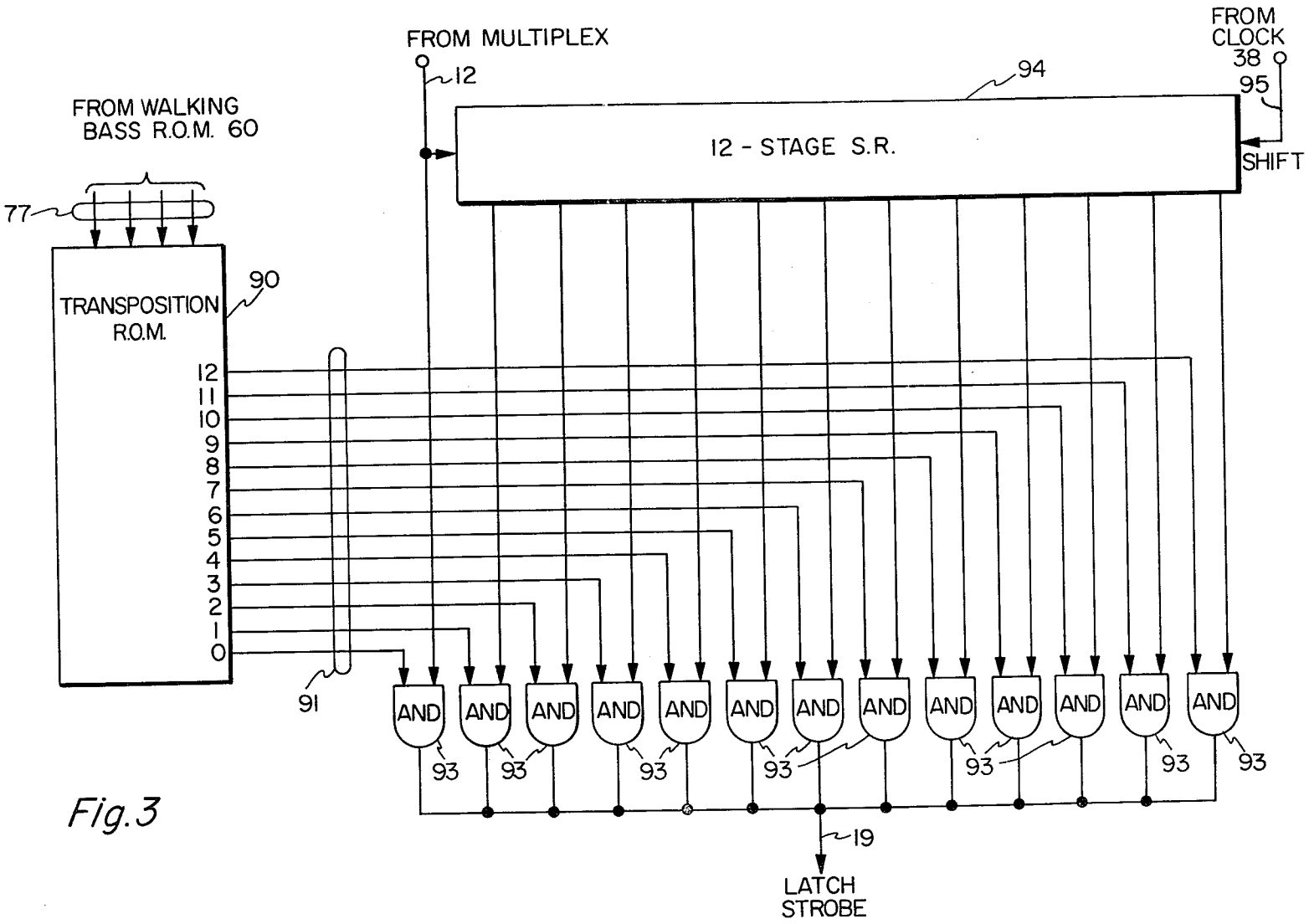
FIG. 3 is a block diagram of another portion of the circuit of FIG. 1 showing such portion in greater detail.

Thus, whenever a pulse appears in the data stream from the multiplex circuit 11, it is shifted sequentially through the shift register 94, causing each output stage of the shift register circuit 94 to be enabled in turn as the pulse is shifted through it. If, during the time the pulse is being shifted through the shift register 94, the ROM walking bass memory outputs 77 are encoded to effect a transposition of the chordal tone to be played for some predetermined length of time, one of the AND gates 93 other than the root note AND gate at the left-hand side of FIG. 3 is enabled. Then, whenever the corresponding stage of the shift register 94 which is connected to the enabled AND gate has the multiplex pulse shifted into it, the corresponding AND gate 93 causes a latch strobe pulse to appear on the lead 19. This effectively amounts to a transposition of the data pulse in the serial multiplex signal stream and causes a latching of the seven-stage latch circuit 16 to occur for a note and an octave selected according to the output of the walking bass ROM circuit 60.

Figure 4:
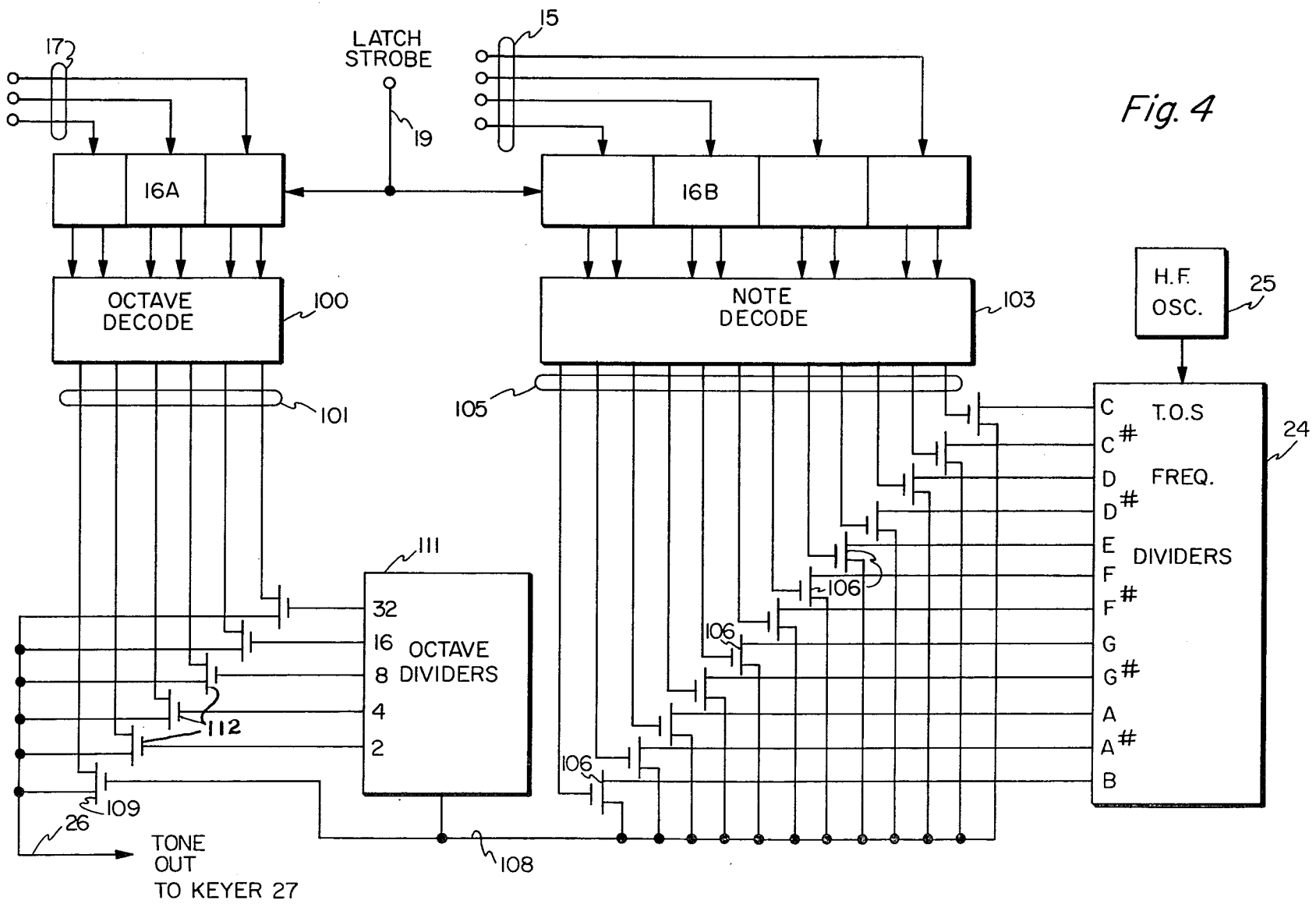
FIG. 4 is a block diagram of an additional portion of the circuit of FIG. 1 to show additional details of the system.

Referring now to FIG. 4, the seven-stage latch circuit is shown in greater detail in conjunction with note and octave decoding circuits and a top octave synthesizer circuit 24 for producing the desired tone on the output lead 26 applied to the tone input of the keyer circuit 27. For the purposes of illustration in FIG. 4, the seven-stage latch circuit 16 is shown divided into two parts, 16A and 16B. The portion 16A comprises three binary stages which are selectively enabled by the octave information appearing on the leads 17 from the multiplex circuit 11. Similarly, the section 16B comprises four binary stages which are selectively enabled by the note information appearing on the leads 15.

Whenever a latch strobe pulse appears on the output lead 19 from the transposition logic circuit of FIG. 3, the octave and note information appearing at that time on the leads 17 and 15, respectively, is stored in the latch circuits 16A and 16B. The binary outputs of the octave latch circuits 16A are applied to an octave decoder circuit 100 which enables, by producing a high potential thereon, one of six octave output leads 101. The manner in which this decoding is effected is conventional. Similarly, the outputs of the latch circuit section 16B are applied to a note decoding circuit 103 to enable one of twelve outputs 105 with a high potential representative of the selected note of the particular octave which is to be produced at the output 28 of the string bass keyer 27.

Each of the twelve tonal outputs of the top octave synthesizer 24 are applied to one input of a corresponding respective FET analog AND gate 106, the other inputs to which constitute the leads 105 from the note decoder circuit 103. Only one of these FET AND gates 106 is enabled at any one time to pass the tone signal frequencies from the top octave synthesizer 24 to a common output lead 108.

The signals appearing on the lead 108 are applied directly to the gate of an FET analog AND gate 109 and also are applied to an octave divider circuit 111 which has five outputs, each representing a division-by-two of the next lower output. The octave divider circuit 111 thus produces outputs at frequency division ratios 2, 4, 8, 16 and 32, as indicated in FIG. 4. These outputs are in turn applied to the gates of corresponding FET analog AND gates 112.

The output frequency tone appearing on the lead 26 then is obtained from the one of the AND gates 109 and 112 which is enabled by a positive potential appearing on the selected lead 101 from the octave decoder 100. This tone is changed under the control of the timing of the latch strobe pulse on the lead 19, as determined by the transposition logic circuit, shown must clearly in FIG. 3.

The chordal note relationships are synchronized with the walking bass keying pulses by the walking bass ROM circuit 60 to produce whatever patterns are encoded in the ROM 60, as selected by the musician in the walking bass pattern selection circuit 61.

It should be noted that each time a new note is selected by the musician in the pedal keyboard circuit 10, the walking bass pattern circuitry is reset to the beginning of its cycle by resetting the counter 71 to zero. Thus, whatever walking bass pattern has been selected by the circuit 61 for reproduction by the walking bass ROM circuit 60, that pattern is restarted at the beginning each time the pedalboard key is depressed by the musician.

In addition, if the musician merely taps different pedal keys in the pedal board 10, the positive pulses of short duration are applied to the terminal 65. These positive pulses then are applied over the lead 32 and through the differentiating circuit 33 to cause the timing pulses passed by the OR gate 34 to be synchronized with the playing by the musician. At the same time, the circuit 85 prevents the walking bass ROM circuit 60 from applying any pulses through the NAND gate 81 which in turn means that only the root note information is passed through the transposition logic of FIG. 3. The playing of the string bass keyer 27 then is controlled directly by the musician himself, substantially overriding the automatic walking bass circuitry, even though it may be energized for operation. At any time the musician holds down or maintains operative a pedal key, the circuit 85 times out and the walking bass ROM circuit 60 regains control of the system operation through the NAND gate 81 and the chordal transposition leads 77 to revert the system back to the automatic walking bass mode of operation.

The system which has been described provides a maximum flexibility to the operation of an automatic walking bass circuit used in conjunction with an electronic organ. It permits a relatively inexperienced musician to substantially increase his playing effectiveness. In addition, the system allows an accomplished musician a great amount of flexibility of utilizing the walking bass features to supplement his own playing. The musician also has the capability of instantaneous override of the walking bass circuitry whenever he so desires. The system automatically synchronizes the walking bass circuitry with the downbeat of a percussion rhythm accompaniment circuitry and is relatively simple to implement into a serial multiplex electronic organ system to increase the musical capabilities of such a multiplex system.

We claim:

1. A tone pattern generating system for use with an electronic musical instrument including, in combination:

a continuously running clock means for producing clock output pulses on an output thereof at a predetermined frequency;

rhythm pattern generating circuit means coupled with said clock means for producing at least one predetermined rhythm pattern for use in said musical instrument;

downbeat divider circuit means having an output, and having an input coupled with the output of said clock means and reset by a predetermined rhythm pattern from said rhythm pattern generating means to produce output pulses on the output of said downbeat divider circuit corresponding to downbeat measures synchronized with the operation of said rhythm pattern generating means; and tone pattern control means coupled with the output of said clock means and with the output of said downbeat divider circuit means for producing predetermined tone patterns in synchronism with the downbeat pulses obtained from said downbeat divider circuit means.

2. The combination according to claim 1 wherein said rhythm pattern generating means includes counter means providing a predetermined output signal in response to a predetermined number of clock output pulses applied thereto from said clock means, and wherein said downbeat divider circuit means comprises a pulse frequency divider means producing an output pulse therefrom in response to a predetermined number of clock output pulses from said clock means, said downbeat divider circuit means being reset to an initial state of operation by said predetermined output signal of said counter means.

3. The combination according to claim 2 further including second counter means in said pattern control means, said second counter means having a reset input coupled with the output of said downbeat divider circuit means and being reset to an initial count by output pulses from said downbeat divider circuit means and further having clock pulse input means coupled with the output of said clock means to cause said second counter means to be advanced in synchronism with the clock pulses produced by said clock means.

4. A tone pattern generating system for use with an electronic musical instrument including in combination:

a continuously running clock means for producing clock output pulses on an output thereof at a predetermined frequency;

pattern control means coupled with the output of said clock means and having at least one first output for supplying signals thereon indicative of chordal tone relationships and having a second output for supplying thereon signals in a predetermined rhythm pattern, the signals of such rhythm pattern corresponding with predetermined ones of the clock pulses from said clock means;

switch means operated to initiate the playing of a note in said instrument;

output means coupled with said switch means and with the first and second outputs of said pattern control means for producing varying musical tones in a predetermined rhythm pattern; and means responsive to operation of said switch means for preventing signals on the second output of said pattern control means from being applied to said output means for a predetermined time interval after operation of said switch means.

5. The combination according to claim 4 further including an additional rhythm pattern generating circuit means coupled with the output of said clock means for producing a repetitive rhythm pattern separate and distinct from the rhythm pattern produced on the second output of said pattern control means.

6. The combination according to claim 5 further including means coupled with said additional rhythm pattern generating means and said clock means for synchronizing operation of said additional pattern generating means and the rhythm pattern produced on the second output of said pattern control means to cause each of said patterns to commence with a downbeat of a musical bar.

7. The combination according to claim 4 wherein said switch means is further coupled with said pattern control means and release of said switch means within said predetermined time interval terminates operation of said pattern control means to prevent said output means from producing musical tones in response to the outputs of said pattern control means.

8. The combination according to claim 7 wherein each different operation of said switch means resets said pattern control means to the beginning of the predetermined rhythm pattern on the second output thereof and to a predetermined sequence of chordal tone relationships on the first output thereof.

9. The combination according to claim 4 wherein said pattern control means comprises a ROM memory storing at least two predetermined chordal tone relationship sequences and at least two predetermined rhythm pattern sequences, and further including means for selecting a predetermined combination of one of said chordal tone relationships and a corresponding one of said rhythm pattern sequences.

10. The combination according to claim 9 further including counter means coupled with the output of said clock means for controlling the ROM memory to produce the selected chordal tone relationship and selected rhythm pattern in synchronism with the output pulses of said clock means.

11. The combination according to claim 10 further including means responsive to operation of said switch means for resetting said counter means to an initial count each time said switch means is operated to initiate playing of a new note in said instrument.

12. The combination according to claim 11 wherein said resetting means is further coupled with the output of said clock means for resetting said counter means in synchronism with the output of said clock means.

13. The combination according to claim 12 further including means coupling said switch means with said output means for producing an output musical tone corresponding with the tone selected by said switch means substantially simultaneously with operation of said switch means.

* * * * *